US005332863A

United States Patent [19]

Emmert

[11] Patent Number: 5,332,863

[45] Date of Patent: Jul. 26, 1994

[54] WIRING INSTALLATION METHOD FOR MODULAR BUILDING STRUCTURES

[76] Inventor: Raymond L. Emmert, 8028 NW 20th, Oklahoma City, Okla. 73127

[21] Appl. No.: 58,300

[22] Filed: May 7, 1993

Related U.S. Application Data

[62] Division of Ser. No. 724,072, Jul. 1, 1991, Pat. No. 5,216,854.

[51] Int. Cl.[5] ..... H02G 3/28

[52] U.S. Cl. ..... 174/48

[58] Field of Search ..... 174/48, 49, 72 A; 52/220.1

[56] References Cited

U.S. PATENT DOCUMENTS 2,941,027 6/1960 Svec ..... 174/72 A
4,163,349 8/1979 Smith ..... 52/241
4,375,010 2/1983 Mollenkopf ..... 174/48
4,631,881 12/1986 Charman ..... 174/48

FOREIGN PATENT DOCUMENTS 2721797 11/1978 Fed. Rep. of Germany ..... 174/48

*Primary Examiner*—Lincoln Donovan
*Assistant Examiner*—D. A. Tone
*Attorney, Agent, or Firm*—Robert K. Rhea

[57] ABSTRACT

A building structure formed from modular units. Each unit comprising a plurality of structurally reinforced insulating panels of standard wall panel dimensions joined in longitudinal edge juxtaposed position. The upper end edge surfaces of the respective wall forming panel core is grooved to form a continuous upwardly open wire harness receiving channel communicating with the respective upper end of a plurality of vertical electrical control wire receiving slots formed in selected wall panels.

3 Claims, 3 Drawing Sheets

WIRING INSTALLATION METHOD FOR MODULAR BUILDING STRUCTURES

CROSS REFERENCE TO RELATED APPLICATION

This application is a division of an application filed by me in the United States Patent and Trademark Office on Jul. 1, 1991, Ser. No. 07/724,072 for LAMINATED PANEL MODULAR BUILDING STRUCTURES, U.S. Pat. No. 5,216,854.

BACKGROUND OF THE INVENTION

1. Field of the Invention

This invention relates to sandwich panels and more particularly to factory fabricated field assembled modular building structures and a method of wiring assembly efficiently utilizing laminated sandwich panels.

There has been much effort and extensive work done in recent years to find solutions to the housing and building needs of third world countries and other low income areas of the world.

Heretofore, most of the efforts to solve the housing and community building needs for the less fortunate have met with little or no success. There are numerous reasons why others have had little success but the primary reason is that no one has been able to deliver a low cost, pre-packaged, factory fabricated, efficient, easy to assemble, structurally sound aesthetically appealing unit to the area of need. In order to meet such demanding criteria, it is necessary to provide a pre-engineered, insulated structural panel which can be produced and fabricated to exacting dimensional and structural standards and then effectively utilize that panel not only for the walls and partitions but also for containing the electrical wiring.

This invention discloses a novel and unique building system which minimizes labor erection costs by utilizing laminated structural panels for the walls and a completely self supporting cathedral type roof.

2. Description of the Prior Art

U.S. Pat. No. 4,375,010 issued Feb. 22, 1983 to Mollenkopf for PANEL CONSTRUCTION INCLUDING ELECTRICAL CONNECTORS discloses a temporary moveable modular panel wall system for office partitions having connectable prewired electrical harness in top panel raceways and transition connectors coupling the electrical lines across connecting posts on which the panels are mounted.

The raceways are formed by an upwardly open panel cavity in the top edge portion of the respective panel which terminates short of the respective vertical frame assembly which include vertical structural frame members that form a main vertical support post for the panels.

A wiring harness having a length less than the width of a single panel is then inserted into each of the upwardly open panel cavities with the harness provided with a connector at the respective end of the panel section of harness. A separate wiring transition harness then bridges the panel supporting post position between adjacent panels in which the bridging harness is provided with cooperative adaptors at its respective ends for connection with the adjacent end of the respective panel harness.

This invention is distinctive over this patent principally by its relating to a permanent wall and wiring installation in which the respective panel of the paneled wall is provided with upwardly open channel-like grooves in its upper end portion forming a continuous upwardly open groove when joined with adjacent panels into which a continuous length of permanent wire, group of wires or wiring harness may be laid and in which lateral runs or lengths of wiring permanently connected with the continuous length of wiring harness may extend vertically into preformed grooves in selected panels at outlet or switch connections for electrical wiring control.

U.S. Pat. No. 4,163,349 issued Aug. 7, 1979 to Smith for INSULATED BUILDING PANELS discloses multiple panel wall structures, preferably assembled as wall units at an off-site location, in which the upper limit of the panel outer skins extend upwardly beyond its core portion to form an upwardly open channel which is partially filled by a spaced-apart pair of headers respectively adjacent the upper inner limit of the respective panel skin. The space between the spaced-apart headers above each panel is selectively filled by spacers which may serve as a header splice plate of a thickness which, when combined with the thickness of the header plates, produces a header beam assembly equal in width with the dimension lumber member used at the base of the multipanel wall. The panel skins are nailed to the respective header plates and the splice plates and with the spacers substantially completely filling the upwardly open double header beam area above the respective panel core. Selected panels are provided with vertically disposed grooves through which wiring may be extended downwardly through open areas between adjacent ends of spacers or between a splice plate and spacer.

This invention is distinctive over this patent by providing an upwardly open horizontal channel-like groove in the top of the respective panel core continuous with the respective length of each wall, formed by structural panels, providing sufficient continuous space for receiving wiring harness. This continuous groove communicates with downward or vertical slots, in selected panels, for receiving wiring runs depending from the principal harness for electrical current access or control. An elongated top rail or beam is placed between upstanding wall panel skins of applicant's panel wall following the wiring harness installation in the channel-like groove for rigidity of the several panels of applicant's wall.

SUMMARY OF THE INVENTION

This invention in general comprises modular components for forming building structures of a particular design.

The wall components are formed by a plurality of structurally reinforced insulating panels joined, in juxtaposed longitudinal edge fashion by splines at a constructor site, at their respective top and bottom ends by elongated dimension lumber for forming relatively large surfaces, such as floors and walls, with cut-outs for doors and windows in the wall areas.

A channel-like groove in each panel core upper end communicates with like grooves in adjacent juxtaposed panels to form a continuous upwardly open horizontal groove for receiving wire harness prior to the installation of the top header.

The principal object of this invention is to provide light weight building structure modules formed from a plurality of insulating panels joined in longitudinal juxtaposed edge wall position having an upwardly open wire harness receiving groove in the top surface of a structure perimeter wall formed by a cooperating plurality of the structural modules.

Another object is to disclose a method of electrically wiring a modular building structure.

DESCRIPTION OF THE PREFERRED EMBODIMENTS

Figure 1:
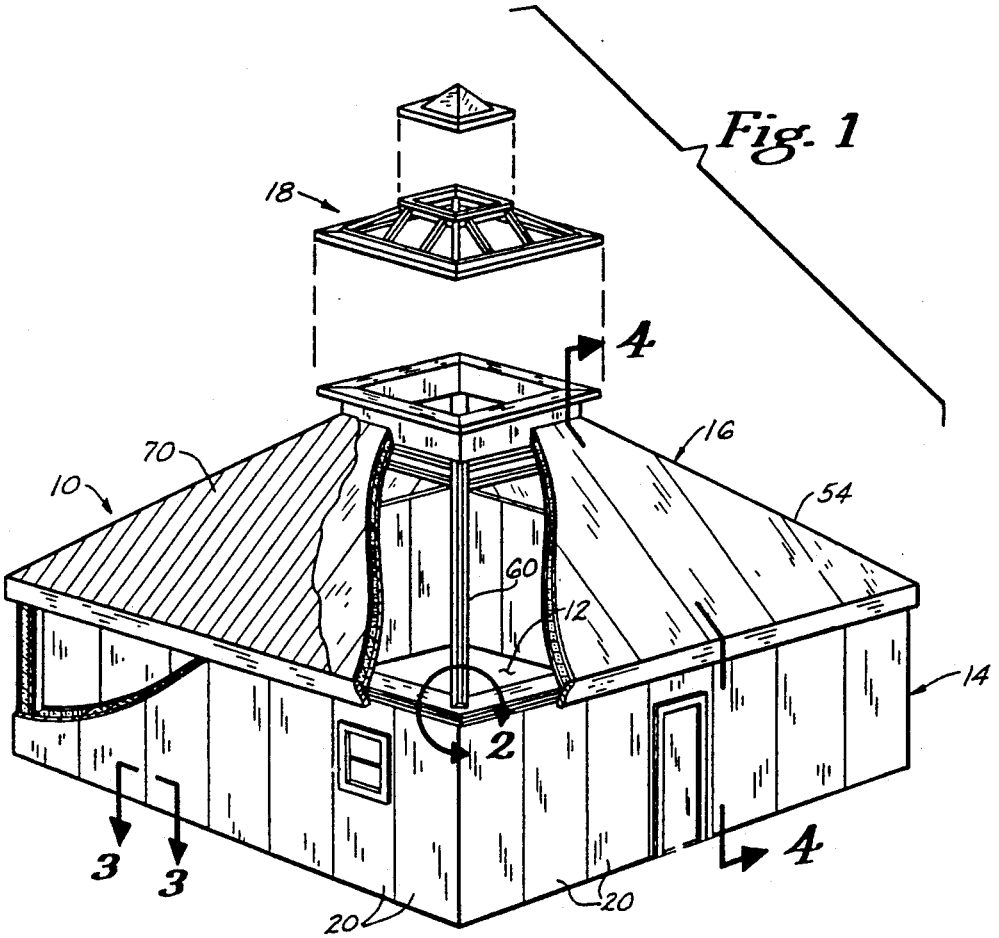
FIG. 1 is a partially exploded, partly in section, perspective view of a building constructed in accordance with the invention.
Figure 2:
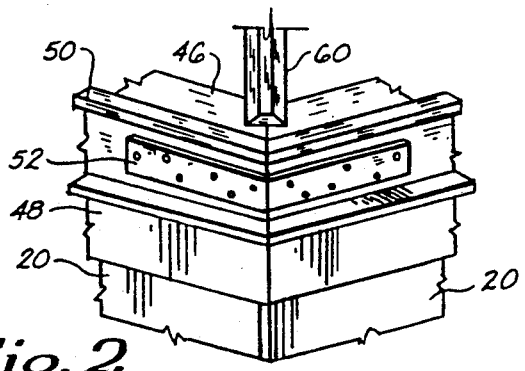
FIG. 2 is a fragmentary perspective view of the area encompassed by the arrow 2 of FIG. 1.

Like characters of reference designate like parts in those figures of the drawings in which they occur.

In the drawings:

The reference numeral 10 indicates a building formed in accordance with this invention. The building 10 may be rectangular, as shown, or any desired perimeter configuration having a floor 12, upstanding walls 14, a roof assembly 16 and a roof apex open box frame assembly 18. The walls of the building 10 are formed by juxtaposed panel members 20. The structure of the panels 20 is fully disclosed in my U.S. Pat. No. 5,081,810, which briefly stated comprises structural boards 22 or skins, bonded to opposing sides of a core formed by selected thickness of synthetic insulating material 24.

The skins 22 project beyond opposing ends of the core insulating material 24 (FIG. 4) a selected distance sufficient for receiving dimension lumber therebetween and electrical wiring harness in a core top end surface horizontal groove 42, as presently explained.

Figure 3:
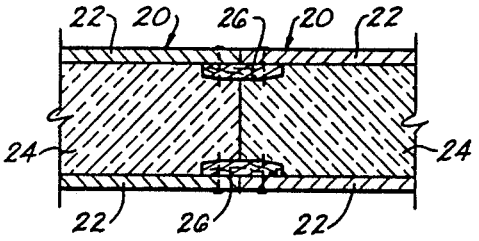
FIG. 3 is a fragmentary horizontal cross sectional view taken substantially along the line 3—3 of FIG. 1.

Longitudinal edges of each panel have the insulating material recessed inwardly adjacent the respective inner surface of the respective skin for receiving splines 26 (FIG. 3) for joining two adjacent panels 20 to each other in edgewise juxtaposed relation.

Each panel 20 is further provided with a pair of longitudinally extending stiffeners, not shown, extending the full length and transversely the thickness of the insulating material to add rigidity to the respective panel.

Figure 4:
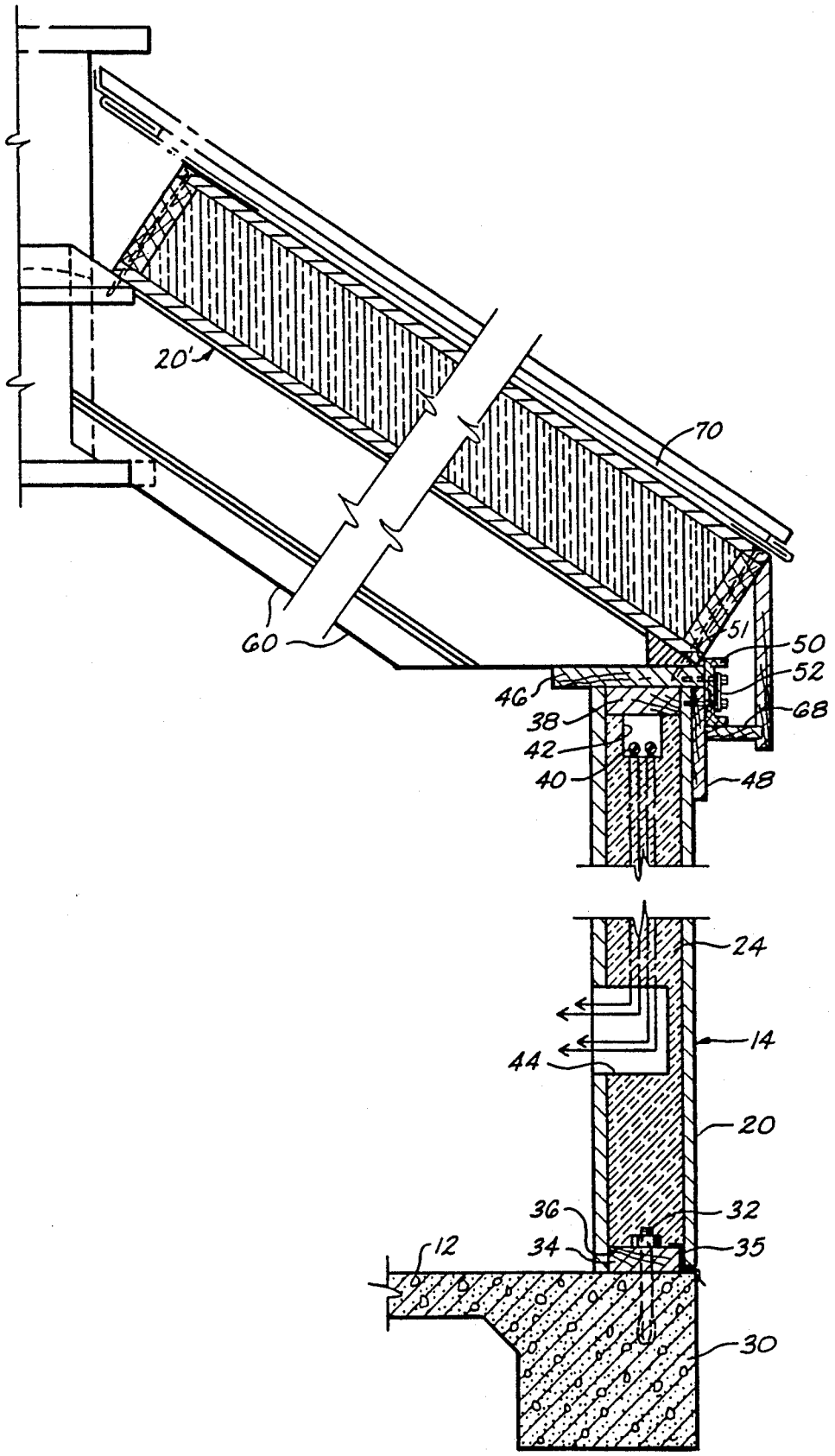
FIG. 4 is a fragmentary vertical cross sectional view, to an enlarged scale, taken substantially along the line 4—4 of FIG. 1; and, FIG. 5 is a fragmentary partially exploded isometric view.
Figure 5:
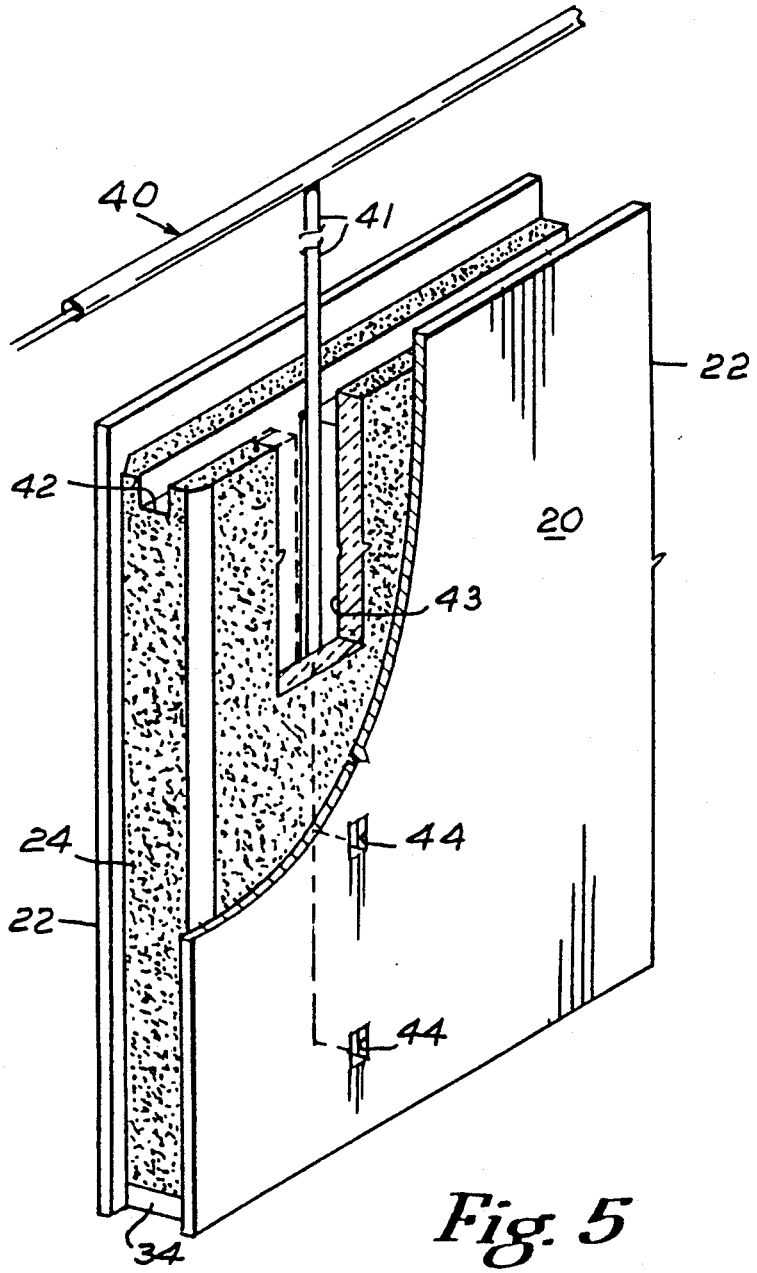

Referring also to FIGS. 4 and 5, the concrete floor 12 and the footing 30 forms the foundation for the building 10. Anchor bolts 32 in the concrete secure a sole plate 34 thereto. Elongated lengths of drain flashing, indicated by the bold line 35, overlies the outer lateral and upper edge portions of the sole plate and foundation.

The required plurality of the panels 20 are joined together in longitudinal edgewise juxtaposed position by the splines 26 as described hereinabove, to form each wall 14.

Each wall 14 is raised into position over the sole plate 34 wherein the wall bottom recess 36, formed by the skins 22 projecting beyond the bottom end of the respective panel 20, nests the sole plate 34. The skins are secured to opposing sides of the sole plate and the outer skin caulked, not shown. Adjacent wall end panels are cooperatively rabbeted in interlocking relation.

Similarly, a top rail 38 is nested by a similar recess in the top edge of each wall 14 formed by panels 20, thus rigidly securing the top and bottom edges of the wall panels 20 forming a wall 14.

Prior to applying the top rail 38, wires 40 which preferably comprises a complete wiring assembly or "harness" unit 40 having a selected number of lateral electrical control wire runs 41 is laid in the panel wall top end portion horizontal grooves 42 and communicating vertical grooves or slots 43 preformed in selected panels to electrical outlet box positions 44 located on panel inner surfaces.

After installing the wiring harness unit 40, a top plate 46 overlies and is secured to the top rail 38. A face plate 48 coextensive with the respective wall 14 overlies its upper outer edge surface under the overhanging edge of the plate 46.

A U-shaped wall reinforcing member 50 extends around the perimeter of the building at the upper limit at its walls and projects above the plane of the top plate to form a roof stop 51 to prevent lateral movement of the roof assembly 16 relative to the walls 14.

The roof assembly 16 including the box frame 18 and its rails 60, the truncated apex triangular roof sections 54 overlayed with roofing 70 is then installed on the upper limit of the walls top plate 46 against the stop 51.

Obviously the invention is susceptible to changes or alterations without defeating its practicability. Therefore, I do not wish to be confined to the preferred embodiment shown in the drawings and described herein.

I claim:

1. The method of electrical wiring the walls of a modular building structure formed by a plurality of upstanding juxtaposed sandwich panels, each panel having a core and having an upwardly open groove in the uppermost end surface of the core forming a coextensive wire receiving horizontal channel and having vertical wire receiving slots in selected panels communicating with the channel and open at their respective depending end through a wall of the respective panel, comprising the steps of:

a) providing a building structure wiring harness unit having a continuous length, between terminal ends, substantially equal with a predetermined portion of a wall to be wired and having longitudinally spaced laterally extending runs equal in number with the selected number of vertical slots open at their depending ends through a panel wall; and, b) inserting said lateral runs into the vertical wall slots while simultaneously laying the continuous length of wiring harness unit in the horizontal channel.

2. The method of electrical wiring the walls of a modular building structure formed by a plurality of upstanding juxtaposed sandwich panels each having a core and having an upwardly open groove in the uppermost end surface of the core forming a continuous wire receiving horizontal channel and having vertical slots in selected panels communicating with the channel and open at their respective depending end through a wall of the respective panel, comprising the step of:

a) placing cooperatively interconnected lengths of electrical wiring, respectively substantially equal in length with a predetermined length of the horizontal channel and the length of the respective vertical slot depending from said wire receiving channel, in said channel and slots.

3. The method of electrical wiring the walls of a modular building structure formed by a plurality of upstanding juxtaposed sandwich panels, each panel having a core and having an upwardly open groove in the uppermost end surface of the core forming a coextensive wire receiving horizontal channel and having vertical wire receiving slots in selected panels communicating with the channel and open at their respective depending end through a wall of the respective panel, comprising the steps of:

a) providing a building structure wiring harness unit having a continuous length extending, from a point of beginning, a distance substantially equal with one-half the building structure perimeter and having a plurality of laterally extending runs intermediate its length equal in number with the selected number of vertical slots open at their depending ends through a panel wall; and, b) inserting said lateral runs into the vertical wall slots while simultaneously laying the continuous length of wiring harness unit in the horizontal channel.

* * * * *